US005116288A

United States Patent [19]

Kondo et al.

[11] Patent Number: 5,116,288

[45] Date of Patent: May 26, 1992

[54] HEADSHADE

[76] Inventors: Kyle K. Kondo, 727 Lukepane Ave., Honolulu, Hi. 96816; George Spector, 233 Broadway Rm. 3815, New York, N.Y. 10007

[21] Appl. No.: 732,485

[22] Filed: Jul. 18, 1991

[51] Int. Cl.[5] ..... A42B 1/00

[52] U.S. Cl. ..... 2/177; 2/9; 2/12; 2/424; 5/419

[58] Field of Search ..... 2/9, 12, 15, 171, 177, 2/184.5, 209.1, 410, 424; 5/416, 419; 280/47.38

[56] References Cited

U.S. PATENT DOCUMENTS

| | | | |
|---|---|---|---|
| 2,036,033 | 3/1936 | Fisher | 5/419 |
| 2,548,601 | 4/1951 | Gottfried | 280/47.38 |
| 3,014,220 | 12/1961 | Weld | 2/171 |
| 3,651,847 | 3/1972 | Casamassima | 2/177 |
| 4,057,855 | 11/1977 | Hovhannessian | 2/177 |
| 4,109,322 | 8/1978 | Ott | 2/177 |
| 4,112,957 | 9/1978 | Biven | 2/410 |
| 4,157,592 | 6/1979 | Hovhannessian | 2/177 |
| 4,556,993 | 12/1985 | Okamura | 2/12 |
| 4,741,053 | 5/1988 | Okamura | 2/12 |

FOREIGN PATENT DOCUMENTS

| | | | |
|---|---|---|---|
| 3620287 | 12/1987 | Fed. Rep. of Germany | 280/47.38 |
| 3164 | of 1907 | United Kingdom | 5/419 |

*Primary Examiner*—Werner H. Schroeder
*Assistant Examiner*—Diana L. Biefeld

[57] ABSTRACT

A head shade is provided that includes a covering which will protect a person's face and head from the rays of the sun when the person is in a reclined position, such as on the beach or the like. The head shade can be folded up and stored when not in use.

4 Claims, 1 Drawing Sheet

HEADSHADE

BACKGROUND OF THE INVENTION

The instant invention relates generally to sunshades and more specifically it relates to a head shade which provides protection from the sun for a person's face and head when in a reclined position.

There are available various conventional sunshades which do not provide the novel improvements of the invention herein disclosed.

SUMMARY OF THE INVENTION

A primary object of the present invention is to provide a head shade that will overcome the shortcomings of the prior art devices.

Another object is to provide a head shade that will protect a person's face and head from the rays of the sun when the person is in a reclined position, such as on the beach or the like.

An additional object is to provide a head shade that can be folded up and stored when not in use.

A further object is to provide a head shade that is simple and easy to use.

A still further object is to provide a head shade that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
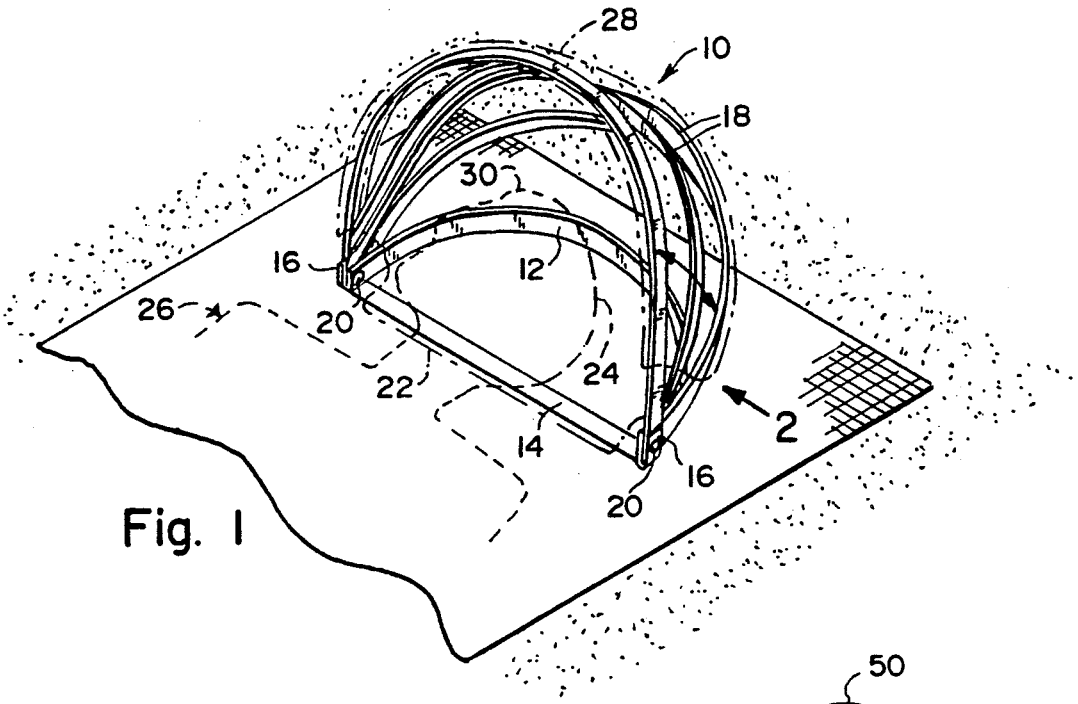
FIG. 1 is a perspective view of the instant invention with the material shown in phantom being used.
Figure 2:
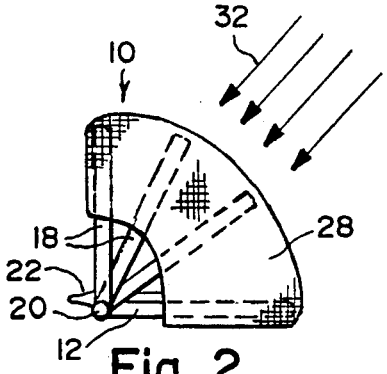
FIG. 2 is a side view taken in direction of arrow 2 in FIG. 1.
Figure 3:
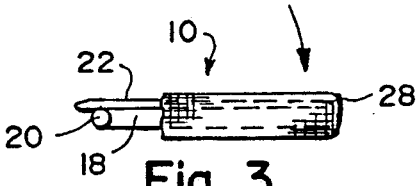
FIG. 3 is a side view in a collapsed position.

Turning now descriptively to the drawings, in which similar reference characters denote similar elements throughout the several views, FIGS. 1 through 3 illustrate a head shade 10 consisting of a flat strip 12 bent in a half round shape, a straight front flat strip 14 having upturned ends 16 and a plurality of curved flat ribs 18. A pair of rivets 20 are for pivotally attaching the ends of the half round strip 12 and the ends of the curved flat ribs 18 to the upturned ends 16 of the straight front flat strip 14. A first flexible sheet 22 is shaped to fit over the half round strip 12 and the straight front strip 14 so that a head 24 of a person 26 can rest thereupon.

A second flexible sheet 28 is shaped to fit over the half round strip 12 and the curved flat ribs 18, so that when the curved flat ribs 18 are pulled into an open position the second flexible sheet 28 will protect the face 30 and head 24 of the person 26 from the rays 32 of the sun when the person 26 is in a reclined position.

Figure 4:
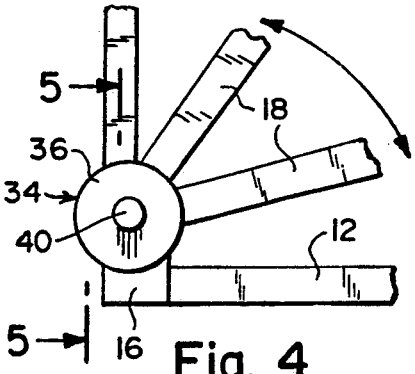
FIG. 4 is a side view of a portion of a modification.
Figure 5:
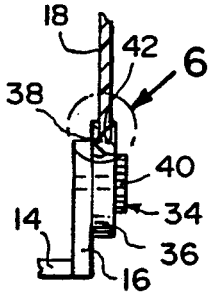
FIG. 5 is a cross sectional view taken along line 5—5 in FIG. 4, showing a track for each removable rib to ride therein.
Figure 6:
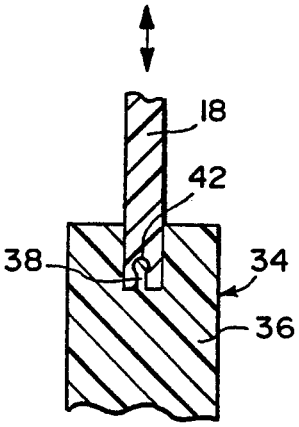
FIG. 6 is an enlarged cross sectional view as indicated by arrow 6 in FIG. 5, showing the track in greater detail.

A portion of a modification is shown in FIGS. 4 through 6, in which the upturned ends 16 of the straight front flat strip 14 are affixed directly to the ends of the half round strip 12. A mechanism 34 is for pivotally and removably attaching the ends of the curved flat ribs to the upturned ends 16 of the straight front flat strip 14.

The pivotally and removably attaching mechanism 34 includes a pair of discs 36, each having an annular male member track 38. A pair of rivets 40 are provided with each affixing one of the discs 36 to one of the upturned ends 16 of the straight front flat strip 14. Each of the curved flat ribs 18 has a female socket 42 at each end so as to engage with the annular male member track 38 in the discs 36.

Figure 7:
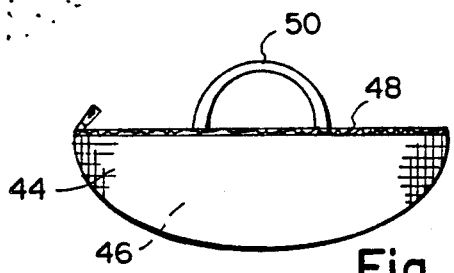
FIG. 7 is a side view of a carrying case for the invention when in a collapsed position.

FIG. 7 shows a carrying case 44 having a compartment 46 to hold the folded head shade 10 therein when not in use. The carrying case 44 also has a ZIPPER 48 for access into the compartment 46 and a handle 50 so that the carrying case 44 can be held therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A head shade which comprises:

a) a flat strip bent in a half round shape;

b) a straight front flat strip having upturned ends;

c) a plurality of curved flat ribs;

d) means for pivotally attaching the ends said half round strip and the ends of said curved flat ribs to the upturned ends of said straight front flat strip;

e) a first flexible sheet shaped to fit over said half round strip and said straight front strip so that a head of a person can rest thereupon; and f) a second flexible sheet shaped to fit over said half round strip and said curved flat ribs, so that when said curved flat ribs are pulled into an open position said second flexible sheet will protect the face and head of the person from the rays of the sun when the person is in a reclined position.

2. A head shade as recited in claim 1, wherein said pivotally attaching means includes a pair of rivets.

3. A head shade which comprises:

a) a flat strip bent in a half round shape;

b) a straight front flat strip having upturned ends which are affixed to the ends of said half round strip;

c) a plurality of curved flat ribs;

d) means for pivotally and removably attaching the ends of the curved flat ribs to the upturned ends of said straight front flat strip;

e) a first flexible sheet shaped to fit over said half round strip and said straight front strip of that a head of a person can rest thereupon; and f) a second flexible sheet shaped to fit over said half round strip and said curved flat ribs, so that when said curved flat ribs are pulled into an open position said second flexible sheet will protect the face and head of the person from the rays of the sun when the person is in a reclined position.

4. A head shade as recited in claim 3, wherein said pivotally and removably attaching means includes:

a) a pair of discs, each having an annular male member track;

b) a pair of rivets, each affixing one of said discs to one of the upturned ends of said straight front flat strip; and c) each of said curved flat ribs having a female socket at each end so as to engage with the annular male member tracks in said discs.

* * * * *